US005328179A

United States Patent [19]

Muse et al.

[11] Patent Number: 5,328,179

[45] Date of Patent: Jul. 12, 1994

[54] FURNISH COMPOSITION

[75] Inventors: Joel Muse, Kent; Dane K. Parker, Massillon; Robert F. Roberts, Uniontown, all of Ohio

[73] Assignee: The Goodyear Tire & Rubber Company, Akron, Ohio

[21] Appl. No.: 787,181

[22] Filed: Nov. 4, 1991

Related U.S. Application Data

[62] Division of Ser. No. 559,129, Jul. 27, 1990, Pat. No. 5,074,963.

[51] Int. Cl.[5] ..... B65D 53/00; F02F 11/00; F16J 15/00; D21H 11/00

[52] U.S. Cl. ..... 277/227; 277/230; 162/164.6; 162/168.2; 162/157.3; 162/170; 525/124; 525/283; 525/331.7; 525/331.9; 525/333.1; 525/374; 525/375; 525/380; 525/381; 525/382; 525/384; 524/555; 524/589; 528/45

[58] Field of Search ..... 277/227, 230; 162/164.6, 168.2, 157.3, 170; 528/45; 524/555, 589; 525/124, 283, 331.7, 331.9, 333.1, 374, 375, 380, 381, 382, 384

[56] References Cited

U.S. PATENT DOCUMENTS

| | | | |
|---|---|---|---|
| 2,759,813 | 8/1956 | Fiegley | 92/21 |
| 3,346,445 | 10/1967 | Gay | 162/164.6 |
| 3,567,695 | 4/1968 | Brotherton et al. | 260/77.5 |
| 3,853,599 | 12/1974 | Kamichika et al. | 524/510 |
| 3,926,875 | 12/1975 | Tsugukuni et al. | 260/23 TN |
| 4,317,575 | 3/1982 | Cavicchio | 277/227 |
| 4,387,178 | 6/1983 | Tracy et al. | 524/448 |
| 4,560,718 | 12/1985 | Ritchey | 524/13 |
| 4,604,439 | 8/1986 | Colvin et al. | 526/288 |
| 4,694,057 | 9/1987 | Smith et al. | 526/206 |
| 4,824,909 | 4/1989 | Togo et al. | 525/124 |
| 4,983,684 | 1/1991 | Weinstein et al. | 525/329.1 |
| 5,043,455 | 8/1991 | Parker et al. | 548/537 |

FOREIGN PATENT DOCUMENTS

| | | |
|---|---|---|
| 56-055475 | 5/1981 | Japan . |
| 56-143261 | 11/1981 | Japan . |
| 57-187238 | 11/1982 | Japan . |
| 61-042546 | 3/1986 | Japan . |

*Primary Examiner*—Paul R. Michl
*Assistant Examiner*—P. Niland
*Attorney, Agent, or Firm*—Alvin T. Rockhill

[57] ABSTRACT

Gasketing paper is commonly made by the beater addition process. In the beater addition process a furnish composition is prepared by mixing latex into a fiber slurry which also typically contains one or more fillers. The beater addition process is currently being scrutinized because of environmental concerns. More specifically, conventional lattices used in the beater addition process contain curatives, such as amines, sulfur, and zinc compounds, which are discharged into the environment via the affluent from the process. By practicing the process of this invention gasketing paper can be manufactured by an environmentally sound technique. In one embodiment of this invention gasketing paper is made by beater addition with the latex utilized in the process being comprised of (a) at least one rubber having both pendant blocked isocyanate groups and groups containing at least one active Zerewitinoff hydrogen, (b) at least one emulsifier, and (c) water.

10 Claims, No Drawings

FURNISH COMPOSITION

This is a divisional of application Ser. No. 07/559,129 filed on Jul. 27, 1990, now issued U.S. Pat. No. 5,074,963.

BACKGROUND OF THE INVENTION

A gasket is an article which is clamped between adjacent faces and acts as a static seal. Depending upon its particular application, a gasket may be required to resist extremely high and/or low temperatures, elevated pressures and/or vacuum, thermal expansion, and various chemicals. The use of gaskets in internal combustion engines is very prevalent. For example, in internal combustion engines gaskets are used to create a seal to keep engine fluids, such as oils, fuels, coolants, within the engine and to keep outside dirt and other contaminants from entering the engine. Gaskets of desired sizes and shapes are often made by stamping them out of gasketing paper.

Gasketing paper is often made by the beater-addition process. The beater-addition process is described in U.S. Pat. No. 2,759,813. In the beater addition process, a slurry of at least one fiber in water is mixed with a rubber latex. This slurry also often contains one or more fillers. The latex in the slurry is precipitated to form a furnish composition. The furnish is then processed into sheet by removing excess water via a cylinder machine, a fourdrinier, or similar processing equipment. Additional water is pressed out of the sheet with vacuum generally being applied to enhance evaporation. The sheet is then further dried in drying ovens or on steam cans. The dried sheet is then generally calendared into gasketing paper having the desired density. Gaskets of the desired shape can then be stamped out of the gasketing paper and cured.

The gasketing paper typically contains curatives, such as amines, sulfur and/or zinc compounds, which are needed to cure conventional rubbers therein. The beater addition process has been criticized from an environmental standpoint because these curatives are released into the environment through the effluent from the process. It would accordingly be desirable to develop a latex of a rubber which can be cured without the need to utilize conventional curatives. Such a rubber composition is disclosed in U.S. patent application Ser. No. 07/315,987, filed on Feb. 27, 1989. Such rubber compositions can be cured (crosslinked) by heating without the need for conventional curatives. Ser. No. 07/315,987 discloses three types of rubber compositions which can be cured without utilizing conventional curatives. The first type of rubber composition described is comprised of (1) at least one rubber having pendant block isocyanate groups bound thereto; and (2) at least one compound which contains at least 2 Zerewitinoff active hydrogens. The second type of rubber composition is comprised of (1) at least one rubber having Zerewitinoff active hydrogens bound thereto; and (2) at least one compound having at least two block isocyanate groups bound thereto. The third type of rubber composition disclosed is comprised of polymer chains having (1) pendant blocked isocyanate groups bound thereto; and (2) Zerewitinoff active hydrogens bound thereto. It is highly preferred for the latices utilized in practicing this invention to contain this "self-curing" type of rubber which has both pendant blocked isocyanate groups and groups containing active Zerewitinoff hydrogen.

SUMMARY OF THE INVENTION

The present invention relates to a process for manufacturing gasketing paper by beater addition which utilizes a latex containing a rubber which can be cured without the need for conventional curatives. The rubbers utilized in such latices are of the type described in U.S. patent application Ser. No. 07/315,987. By utilizing such latices the environmental problem of curatives being released into the environment through the effluent from the beater addition process is overcome.

There are additional benefits associated with utilizing the techniques of this invention. For instance, the gasketing paper made in accordance with this invention can be processed at higher temperatures without the risk of precure. This offers greater flexibility in calendaring operations and subsequent processing of the gasketing paper. The "self-curing" rubbers utilized in the gasketing paper can also be bound to functional groups, such as hydroxyl moieties, which may be present in the fibers utilized in the gasketing paper. It is also believed that gasketing paper having improved polymer stability can be made utilizing the techniques disclosed herein.

The present invention specifically discloses a furnish composition which is comprised of (a) at least one rubber having pendant blocked isocyanate groups bound thereto, (b) at least one water insoluble compound which contains at least 2 Zerewitinoff active hydrogens, (c) at least one fiber, and (d) water.

The subject invention also reveals a furnish composition which is comprised of (a) at least one rubber having functionalized groups containing at least one Zerewitinoff active hydrogen, (b) at least one water insoluble compound which contains at least two blocked isocyanate groups, (c) at least one fiber, and (d) water.

This invention also relates to a furnish composition which is comprised of (a) at least one rubber which contains both blocked isocyanate groups and groups containing active Zerewitinoff hydrogen, (b) at least one fiber, and (c) water.

The present invention also reveals a process for manufacturing gasketing paper by beater-addition, the improvement which is characterized by utilizing a latex which is comprised of (a) at least one rubber having pendant blocked isocyanate groups bound thereto, (b) at least one water insoluble compound which contains at least 2 Zerewitinoff active hydrogens, (c) at least one emulsifier, and (d) water.

The subject invention also discloses a process for manufacturing gasketing paper by beater-addition, the improvement which is characterized by utilizing a latex which is comprised of (a) at least one rubber having functionalized groups containing at least one Zerewitinoff active hydrogen, (b) at least one water insoluble compound which contains at least two blocked isocyanate groups, (c) at least one emulsifier, and (d) water.

This invention further reveals a process for manufacturing gasketing paper by beater-addition, the improvement which is characterized by utilizing a latex which is comprised of (a) at least one rubber which contains both blocked isocyanate groups and groups containing active Zerewitinoff hydrogen, (b) at least one emulsifier, and (c) water.

The subject invention also relates to gasketing paper which is comprised of (a) at least one dry rubber having pendant blocked isocyanate groups bound thereto, (b) at least one water insoluble compound which contains at least two Zerewitinoff active hydrogens, and (c) at least one fiber.

The present invention also discloses gasketing paper which is comprised of (a) at least one dry rubber having Zerewitinoff active hydrogens bound thereto, (b) at least one compound having at least 2 blocked isocyanate groups bound thereto, and (c) at least one fiber.

This invention further relates to gasketing paper which is comprised of (a) at least one dry rubber which is comprised of polymer chains having pendant blocked isocyanate groups bound thereto and Zerewitinoff active hydrogens bound thereto, and (b) at least one fiber.

DETAILED DESCRIPTION OF THE INVENTION

The latices utilized in the beater addition process of this invention do not rely upon sulfur or sulfur containing compounds to be cured. In fact, it is not necessary to utilize any conventional curatives in vulcanizing such rubbers. The rubbers utilized in the latices called for in the practice of this invention have cure systems which rely upon the reaction between a block isocyanate group and an active Zerewitinoff hydrogen atom.

The following reaction depicts the curing of a rubber having pendant blocked isocyanate groups bound thereto with a curative which contains two Zerewitinoff active hydrogens. In the first step of the reaction, the blocking agent represented as X is removed from the isocyanate group by the action of heat as follows:

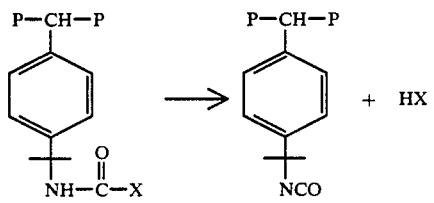

wherein P represents polymer chains of the rubber. In the second stage of the curing reaction, the curative containing two active Zerewitinoff hydrogens reacts with the free isocyanate groups on two different polymer chains of the rubber being cured. This reaction is depicted as follows:

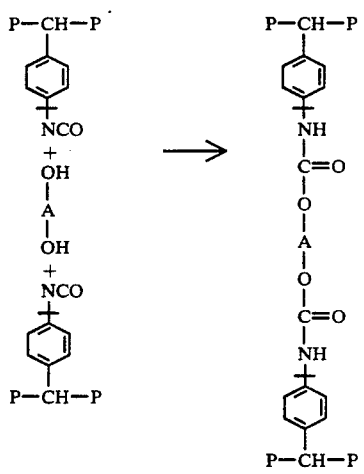

wherein A represents an alkylene group or an arylene group. The same basic reactions are utilized in curing rubbers having active Zerewitinoff hydrogens bound thereto with curatives containing at least two blocked isocyanate groups. In such reactions, the heat utilized to cure the rubber causes the blocking group to be removed thereby creating a free isocyanate group which is then available to react with active Zerewitinoff hydrogens on the rubber. Similarly, identical reactions take place wherein the rubber being cured contains both pendant blocked isocyanate groups and active Zerewitinoff hydrogen atoms. In such cases, it is, of course, not necessary to utilize a separate curative. In other words, rubbers which contain both pendant blocked isocyanate groups and Zerewitinoff active hydrogen atoms have a built in cure package.

Latices of rubbers having pendant blocked isocyanate groups bound thereto can be prepared utilizing a wide variety of techniques. For instance, U.S. Pat. No. 4,429,096 discloses a process wherein the isocyanate group on meta-TMI is blocked with a cationic carbonic structure and then polymerized into a polymer. The technique disclosed in U.S. Pat. No. 4,429,096 is highly suitable for preparing rubbers having pendant blocked isocyanate groups which can be utilized in accordance with the process of this invention. U.S. Pat. No. 4,604,439 also discloses a technique for incorporating blocked TMI into polymers utilizing emulsion polymerization. The teachings of U.S. Pat. Nos. 4,429,096 and 4,604,439 are incorporated herein by reference in their entirety. U.S. Pat. No. 4,694,057 discloses a technique for polymerizing unblocked TMI into rubbers utilizing an emulsion polymerization technique. Such rubbers containing unblocked TMI can be blocked by reacting the rubber containing unblocked TMI with an appropriate blocking agent. In fact, any rubber containing pendant unblocked isocyanate groups can be blocked by reacting the unblocked isocyanate groups thereon with an appropriate blocking agent.

A wide variety of compounds can be utilized to block isocyanate groups in accordance with the process of this invention. Some representative examples of suitable compounds for utilization as blocking agents include phenols, oximes, caprolactam, pyrrolidone, mercaptans and $\beta$-keto esters. Blocking agents which can be utilized are discussed in greater detail in Z. Wicks, Journal of Coatings Technology, "Progress in Organic Coatings", Vol 5 page 73 (1975) and Z. Wicks Journal of Coatings Technology, "Progress in Organic Coatings", Vol. 9, page 3 ( 1981 ), which are incorporated herein by reference in their entirety.

The blocking agents which are preferred for utilization in the process of this invention include alcohols, cyclic amides, ketoximes, phenols, and secondary amines. The cyclic amides which can be utilized typically have the structural formula:

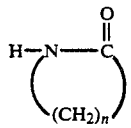

wherein n is an integer from 2 to about 10. It is normally preferred for n to be an integer from 3 to 5. Caprolactam which has the structural formula:

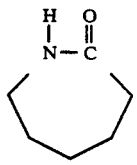

and a deblocking temperature which is within the range of about 110° C. to about 140° C. and 2-pyrrolidone which has the structural formula:

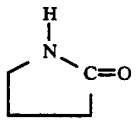

and a deblocking temperature which is within the range of about 160° C. to about 190° C. are highly preferred blocking agents.

The ketoximes which can be utilized as blocking agents typically have the structural formula:

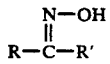

wherein R represents an alkyl group containing from 1 to 10 carbon atoms and wherein R' represents a hydrogen atom or an alkyl group containing from 1 to 10 carbon atoms. Phenol and substituted phenols can also be utilized as the blocking agent. The secondary amines which can be utilized as blocking agents typically have the structural formula:

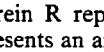

wherein R represents an aryl group and wherein R' represents an aryl or an alkyl group.

A rubber having pendant blocked isocyanate groups bound thereto wherein 2-pyrrolidone is utilized as the blocking agent is depicted as follows:

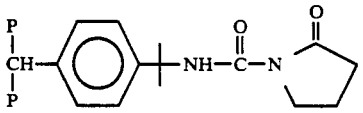

wherein P represents polymer chains of the rubber. 2-pyrrolidone is a particularly valuable blocking agent because it has a deblocking temperature which is within the range of about 160° C. to about 190° C. When the blocked isocyanate is heated to the deblocking temperature, the blocking group is released exposing the free isocyanate. The free isocyanate then undergoes the curing reaction. In cases where the isocyanate is not blocked, premature crosslinking reactions occur making processing of the elastomer difficult if not impossible. Different blocking groups can be employed depending on what processing and curing temperatures are desired. If the rubber is processed at temperatures higher than the deblocking temperature, premature crosslinking or scorch of the rubber will occur. The higher the deblocking temperature is, the more latitude there is in processing of the rubber but cure temperatures must, of course, be higher in order for deblocking and subsequent crosslinking to occur. As the deblocking temperature is lowered, the rubber must be processed more gently but can be effectively cured at a lower temperature. Thus, the deblocking group can be chosen to give the optimal mix of scorch safety and cure temperature. The deblocking temperature of 2-pyrrolidone has been found to be very good in some applications. The deblocking temperature of caprolactam is somewhat lower but can also be used effectively as a blocking agent in curing some rubber compounds.

Zerewitinoff active hydrogen is reactive as determined by the Zerewitinoff method as described in the Journal of the American Chemical Society, Vol. 49, page 3181 (1927). The Zerewitinoff active hydrogen will typically be present in a hydroxyl group, amine group, carboxyl group or thiol group. Zerewitinoff hydrogens which are present in hydroxyl groups are the most highly preferred. Zerewitinoff hydrogen atoms which are present in amine groups are also very good. However, amines react very readily with isocyanate groups which results in a very fast rate of cure. In fact, the rate of cure attained utilizing amines as the source of Zerewitinoff active hydrogen atoms can be too fast. The Zerewitinoff hydrogen present in carboxyl groups is far less active and promotes a much slower rate of cure. For this reason, carboxyl groups are not a preferred source of Zerewitinoff active hydrogen. The optimum rate of cure is believed to be attained when hydroxyl groups are utilized as the source of Zerewitinoff active hydrogen. Curatives can be utilized which contain at least two Zerewitinoff active hydrogen atoms. These compounds will typically have boiling points which are above the cure temperature of the rubber composition. In cases where the curative contains at least two blocked isocyanate groups, the blocking groups will also have a boiling point which is above the cure temperature utilized in crosslinking the rubber composition.

Catalysts can be utilized in order to accelerate the reaction between the Zerewitinoff active hydrogen and isocyanate groups. Such catalysts are of particular importance in cases where the blocking agent has a very high deblocking temperature. For instance, the utilization of such catalysts is of particular value in cases where 2-pyrrolidone is utilized as the blocking agent. Catalysts capable of speeding up both the deblocking reaction and the reaction of the free isocyanate groups with the Zerewitinoff active hydrogen can be utilized. For example, tin salts, bismuth compounds, mercury compounds, tertiary amines, iron acetyl acetonate, cobalt acetyl acetonate and nickel acetyl acetonate can be utilized as the catalyst. Tin salts such as dibutyltin dilaurate, dimethyltin dilaurate, dibutyltin diacetate, and dimethyltin diacetate are most preferred. Dialkyltin sulfides are also highly preferred catalysts. However, in the beater-addition process there is often no need to utilize a catalyst.

The rubber compositions of this invention will typically contain from about 0.001 moles to about 0.4 moles of blocked isocyanate groups per 100 grams of polymer. The rubber compositions of this invention will preferably contain from about 0.005 moles to about 0.1 moles of blocked isocyanate groups per 100 grams of polymer. Such rubber compositions will more preferably contain from about 0.01 to about 0.03 moles of blocked isocyanate groups per 100 grams of rubber. The rubber compositions of this invention will typically have a molar ratio of Zerewitinoff active hydrogen atoms to blocked isocyanate groups of at least about 0.5:1. Such rubber compositions will typically have a ratio of Zerewitinoff active hydrogen atoms to blocked isocyanate groups which is within the range of about 0.6:1 to about 4:1. The ratio of Zerewitinoff active hydrogen atoms to blocked isocyanate groups in the rubber composition will preferably be within the range of about 0.7:1 to about 3:1. More preferably, the ratio of Zerewitinoff active hydrogen atoms to blocked isocyanate groups will be within the range of about 0.8:1 to about 2:1. However, it should be noted that a very substantial excess of Zerewitinoff active hydrogen atoms over the amount of blocked isocyanate groups present typically is not detrimental in rubbers containing both pendant blocked isocyanate groups and Zerewitinoff active hydrogen atoms.

Latices containing the self-curing rubber compositions of this invention can be utilized in standard beater-addition techniques for manufacturing gasketing paper. The beater-addition process is described in detail in U.S. Pat. No. 2,759,813 which is hereby incorporated by reference. However, it is not necessary to include any conventional curatives in the gasketing paper composition. In other words, standard beater addition procedures can be used. The fiber slurry utilized in the beater addition process can contain standard amounts of conventional fibers. For example, the fiber utilized can be a cellulose fiber, aramid fiber, polyester fiber, polyolefin fiber, glass fiber or mixtures of these fibrous materials. Kevlar TM and Nomex TM which are available from the E. I. dupont de Nemours Company, are representative examples of aramid fibers which can be used. Kevlar TM is poly(p-phenylene terephthalamide) and has a tensile strength similar to that of steel. Nomex TM is poly(m-phenylene terephthalamide) and is believed to be made by the copolymerization of m-phenylenediamine and isophthaloyl chloride. The aqueous slurry will also contain conventional amounts of standard fillers, such as clay, talc, diatomaceous earth, silicates, carbonates, barytes, and mixtures thereof. Coloring additives, such as carbon black and red iron pigment, can also be included in the aqueous slurry.

The relative amounts of rubber, fiber and filler in the slurry and furnish made therefrom can vary widely. For instance, in cases where aramid fibers, such as Kevlar ®, are employed large quantities of fillers can be employed. In cases where cellulose fibers are utilized it may not be desirable to include any filler in the aqueous fiber slurry.

A typical fiber slurry utilized in the beater addition process might contain from about 5 to about 25 weight percent aramid fiber and from about 75 to 95 weight percent fillers (based upon the total dry weight of the fiber and filler in the slurry). It will normally be preferred for such slurries to contain from about 8 to about 15 weight percent aramid fiber and from about 85 to about 92 weight percent fillers. In the beater-addition process, the amount of rubber in the latex added to the aramid fiber/filler slurry will typically represent 10 to 30 percent of the dry weight fiber and the dry weight of the filler in the slurry. It is normally preferred for the amount of rubber in the latex to represent 14 to 20 weight percent of the total fiber/filler weight.

In cases where cellulose fibers are utilized it is not necessary to include any fillers in the fiber slurry. However, a large quantity of latex will generally be added to such slurries. For example, the amount of dry rubber in the latex added to such a cellulose slurry will typically represent 10 to 150 percent of the dry weight of the cellulose fibers in the slurry. It is normally preferred for the amount of dry rubber in the latex added to such cellulose slurries to represent 20 to 130 percent of the dry weight of the cellulose fibers in the slurry.

U.S. Pat. No. 4,317,575 discloses a high temperature, asbestos-free gasket which is comprised of (a) from about 5 to about 20 weight percent of a rubber (organic latex binder), (b) from about 5 to about 35 weight percent of cellulosic fiberous material, (c) from 0 to about 30 weight percent mineral wool, (d) at least about 50 weight percent inorganic filler, and (e) from 0 to 5 weight percent of a coloring agent. The gaskets disclosed in U.S. Pat. No. 4,317,575 can also be made using the self curing rubbers of this invention. The teachings of U.S. Pat. No. 4,317,575 are accordingly incorporated herein by reference.

The self curing rubbers which are useful in the process of this invention will normally contain repeat units which are derived from one or more diene monomers and will also contain both blocked isocyanate groups and groups containing active Zerewitinoff hydrogen. Acrylonitrile and vinyl aromatic monomers, such as styrene, can also be included in the rubber. For example, a highly preferred self curing rubber which can be used in the process of this invention is a "modified" nitrile rubber which contains blocked isocyanate groups, groups containing active Zerewitinoff hydrogen atoms, repeat units which are derived from 1,3-butadiene, and repeat units which are derived from acrylonitrile.

The following examples are merely for the purpose of illustration and are not to be regarded as limiting the scope of the invention or the manner in which it can be practiced. Unless specifically indicated otherwise, parts and percentages are given by weight.

EXAMPLE 1

Tetrahydro-N-[1-methyl-1-[3-(1-methylethenyl) phenyl]ethyl]-2-oxo-1-H-pyrrolo-1-carboxamide (BTMI) has the structural formula:

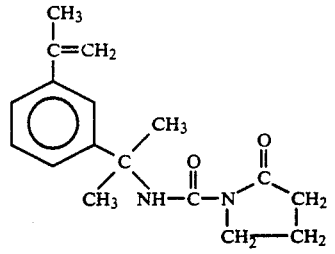

and is an excellent choice as a monomer having pendant blocked isocyanate groups which can be polymerized into rubbers. BTMI is a solid at room temperature and is readily soluble in most monomers commonly used in making synthetic rubber, such as styrene, acrylonitrile, 1,3-butadiene, isoprene, acrylates, vinylidene chloride, and the like. It will also readily polymerize by emulsion free radical means under a wide variety of conditions with varying initiator systems, such as azo compounds, peroxides, persulfates and redox systems. Additionally, BTMI will not retard normal polymerization rates.

Rubbers having pendant blocked isocyanate groups which are made with BTMI do not deblock at temperatures below about 160° C. This is highly desirable since deblocking at low temperatures can result in premature crosslinking (precure) during the beater-addition process.

Rubbers which are made utilizing BTMI as a comonomer have units which are derived from BTMI incorporated therein. These repeat units which are derived from BTMI have the following structure:

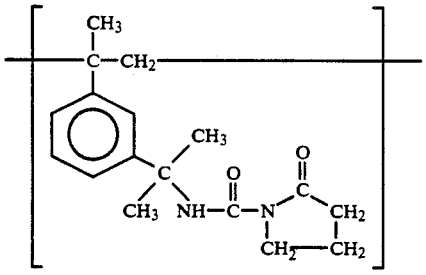

and can be distributed throughout the polymer chains of the rubber in an essentially random manner. Such rubbers will also typically contain repeat units which are derived from conjugated diene monomers, such as isoprene or 1,3-butadiene and can be deblocked by simply heating to temperatures above about 160° C. The deblocking reaction is very fast at temperatures within the range of about 180° C. to about 200° C. As a result of the deblocking reaction, repeat units having the structural formula:

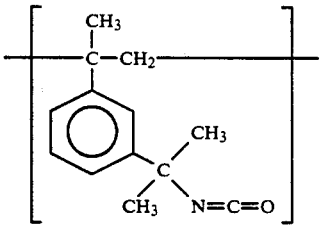

which contain unblocked isocyanate groups are formed and 2-pyrrolidinone (2-pyrrolidone) is liberated. The 2-pyrrolidinone is believed to be relatively non-toxic and has a boiling point of 245° C.

BTMI monomer can be synthesized by the reaction of 1-(1-isocyanato-1-methylethyl)-3-(1-methylethenyl)-benzene (TMI) with 2-pyrrolidinone. This reaction can be carried out over a very wide temperature range with temperatures within the range of about 80° C. to 150° C. being typical. It is generally preferred for this reaction to be conducted at a temperature within the range of 90° C. to 120° C. with temperatures in the range of 95° C. to 110° C. being most preferred. In this reaction one mole of TMI reacts with one mole of 2-pyrrolidinone to produce one mole of BTMI. It is normally preferred for a slight excess of 2-pyrrolidinone to be utilized in the reaction. For example, it is advantageous to employ the 2-pyrrolidinone in an excess of about 2 to about 5 mole percent. The reaction product can be mixed into an aliphatic liquid hydrocarbon to induce crystallization of the BTMI. The aliphatic liquid hydrocarbon will normally be an alkane containing from 5 to 10 carbon atoms, such as hexane, pentane, or octane. The ratio of the aliphatic hydrocarbon employed to the reaction product will normally be from 2:1 to 10:1 by volume and will preferably be from 3:1 to 5:1 by volume.

In this experiment a 5 liter 3-neck flask equipped with a mechanical stirrer, addition funnel, nitrogen inlet and condenser was flushed with nitrogen and charged with 1.065 kg (12.5 moles) of 2-pyrrolidinone and 300 grams of TMI. The mixture was then heated to 100° C. where a small exotherm was noted. At this point, an additional 2.1 kg (10.45 moles) of TMI was added at a rate sufficient to maintain a reaction temperature between 100°-105° C. Additional heat had to be supplied toward the end of the addition. The reaction was allowed to proceed at 105° C. for 2 hours after the addition and then allowed to stand at room temperature for 72 hours. Upon stirring the viscous product with excess hexane at room temperature, the BTMI product slowly crystallized into a dense white solid. The BTMI was then filtered, washed with hexane and dried with 3.19 kg of product being recovered (yield of 93.4%).

EXAMPLE 2

Hexahydro-N-(1-methyl-1-(3-(1-methylethenyl)phenyl) ethyl-2-oxo-1H-azepine-1-carboxyamide (CTMI) is another monomer containing blocked isocyanate groups which can be easily polymerized into rubber latices utilized in practicing this invention. CTMI is very similar to BTMI except for being blocked with caprolactam groups.

In this experiment, CTMI was synthesized by charging 27.72 grams (0.245 moles) of caprolactam into a 250 ml three neck round bottom flask fitted with a mechanical stirrer, nitrogen gas inlet, dropping funnel, thermometer and a water cooled condenser. The caprolactam was purged with a slow nitrogen stream and warmed to 90°-95° C. with stirring. Then 45.2 grams (0.225 moles) of m-TMI was added dropwise from the addition funnel over a thirty minute period. The reaction was allowed to proceed at 90°-95° C. for 8-10 hours after the m-TMI addition. The progress of the reaction was monitored by following the decrease in the isocyanate absorption bad at 2255 cm in the infrared spectrum. After the 2255 cm band had essentially disappeared, the reaction mixture was cooled to room temperature and 130 cc of n-hexane was added with vigorous stirring. The hexane induced the CTMI to crystallize. The crystalline product was filtered, washed with hexane and dried to give 57.4 grams (89% crude yield) of CTMI, having a melting point of 53°-56° C.

EXAMPLE 3

In this experiment CTMI was polymerized into a self curing rubber. This rubber was comprised of repeat units which were derived from 1,3-butadiene monomer, acrylonitrile, CTMI and hydroxypropylmethacrylate (HPMA). Such self curing rubbers have been found to be very useful in the rubber latices utilized in the beater-addition techniques of this invention. Such rubbers will typically contain from about 40% to about 60% butadiene, from about 20% to about 40% acrylonitrile, from about 3% to about 8% CTMI, and from about 1% to about 4% HPMA. Such rubbers will preferably contain from about 50% to about 56% butadiene, from about 35% to about 45% acrylonitrile, from about 4% to about 6% CTMI and from about 2% to about 3% HPMA (the above percentages are by weight).

In this experiment, such a rubber was prepared by charging 365 grams of water, 23 grams of the potassium salt of rosin acid, 0.25 grams of sodium sulfate, 0.75 grams of potassium hydroxide, 0.5 grams of potassium persulfate, 98.75 grams of acrylonitrile, 13.75 grams of CTMI, 5.75 grams of HPMA, and 131.75 grams of 1,3-butadiene into a quart polymerization bottle. The polymerization was carried out at a temperature of 125° F. (52° C.) to completion. The latex synthesized was diluted with 200 ml of water and subsequently vacuum stripped until 160 ml of water had been removed. This vacuum stripping procedure was carried out to remove residual acrylonitrile which was present in the latex. After the steam stripping procedure, the latex had a final solids content of 37.5%.

EXAMPLE 4

In this experiment gasketing paper was made by beater-addition. In the procedure utilized 700 grams of water, 7.1 grams of Kevlar TM (refined aramid pulp), and 22.8 grams of clay (Georgia Kaolin WP-SD) were mixed in a high speed blender. A fiber/filler slurry was prepared by running the high speed blender at full power during two ten second mixing bursts. The fiber/-filler slurry was then transferred to a one gallon stainless steel beaker. 2,077 grams of water and 2 grams of paper maker grade aluminum sulfate (38% on binder) was then added to the beaker. The pH of the slurry was adjusted with ammonium hydroxide to within the range of 7.0 to 8.0. 13 grams of the latex made in Example 3 was then mixed into the slurry. This latex contained 5.2 grams of dry rubber. The rubber in the latex contained 39.5% acrylonitrile, 52.7% butadiene, 2.3% hydroxypropylmethacrylate, and 5.5% caprolactam blocked m-TMI. The latex was precipitated in the presence of the dispersed fibers and fillers over a period of about 7 minutes. The furnish was transferred to a Williams sheet mold. The sheet thus formed was subsequently removed by couch rolling which transferred it to a drying (support) media. The sheet was subsequently transferred to an 8 inch by 8 inch (20.3 cm×20.3 cm) wet press with a pressure of 4.7 pounds per square inch ($3.2\times10^4$ Pascals) being applied for five minutes. The sheet was then transferred to a drying rack where it was maintained at 250° F. (121° C.) for 30 minutes. The edges were then trimmed off the sheet and the resulting 7.5 inch by 7.5 inch (19 cm×19 cm) sheet was densified between release coated stainless steel plates for one minute at a pressure of 365 PSI ($2.5\times10^6$ Pascals) and temperature of 250° F. (121° C.).

The gasketing paper made by this procedure had a thickness of 26.5 mils (0.673 ram). It had a basis weight of 448.1 pounds (203 kg) per 3,000 square feet (279 square meters). The gasketing paper also had a density of 66.4 pounds per cubic foot (1.06 grams per cubic cm). The gasketing paper was evaluated and found to be satisfactory in every way. For instance, the gasketing paper made was determined to have a tensile strength of 1,743 pounds per square inch ($1.202\times10^7$ Pascals). The gasketing paper was also tested for water and oil absorption. After being immersed in water for 22 hours, the gasketing paper showed a weight gain (absorption) of 10.3%. It also showed an increase in thickness (swell) of 2.4% after the 22 hours of water immersion. ASTM fuel B immersion results (5 hours at room temperature) showed a weight gain (absorption) of 21.3% and a swell of 3.6%. The ASTM No. 3 oil testing (149° C. after 5 hours) showed a weight gain of 39.6% and a swell of 3.7%.

This example shows that satisfactory gasketing paper can be prepared utilizing the techniques of this invention without the need for utilizing conventional curing agents. Thus, by practicing the process of this invention curatives can be eliminated from the effluent generated by the beater-addition process for making gasketing paper.

EXAMPLE 5

In this experiment, a rubber latex was synthesized utilizing the BTMI prepared in Example 1. The synthesis technique utilized was identical to that described in Example 3 except for the fact that BTMI was substituted for the CTMI utilized in Example 3. After carrying out this procedure, the latex made had a solids content of 37.6 percent.

EXAMPLE 6

The procedure utilized in Example 4 was repeated in this experiment, except that the latex synthesized in Example 5 was substituted for the latex utilized in Example 4. The m-TMI repeat units in the rubber utilized in the latex employed in this experiment was blocked with pyrrolidone rather than caprolactam. The gasketing paper produced was satisfactory in every way.

The gasketing paper made utilizing this procedure had a thickness of 27 mils (0.68 mm). It had a basis weight of 445.2 pounds (202 Kg) per 3,000 square feet (279 square meters). The gasketing paper also had a density of 65.96 pounds per cubic foot (1.0565 grams per cubic cm). It was also determined to have a 15 tensile strength of 1,526 pounds per square inch ($1.052\times10^7$ Pascals). The gasketing paper was also tested for water and oil absorption. After being immersed in water for 22 hours, the gasketing paper showed a weight gain of 7% and showed an increase in thickness (swell) of 1.1%. The ASTM fuel B immersion (5 hours at room temperature) resulted in a weight gain of 24.2% and a swell of 1.2%. ASTM No. 3 oil testing (300° F. after 5 hours) showed a weight gain of 42.7% and a swell of 3.7%.

What is claimed is:

1. A furnish composition which is comprised of (a) at least one rubber having pendant blocked isocyanate groups bound thereto wherein said rubber is comprised of repeat units which are derived from one or more diene monomers, (b) at least one water insoluble compound which contains at least 2 Zerewitinoff active hydrogens, (c) at least one fiber, and (d) water.

2. Gasketing paper which is comprised of (a) at least one dry rubber having pendant blocked isocyanate groups bound thereto wherein said rubber is comprised of repeat units which are derived from one or more diene monomers, (b) at least one water insoluble compound which contains at least two Zerewitinoff active hydrogens, and (c) at lest one fiber.

3. A gasket made with gasketing paper which is comprised of (a) at least one dry rubber which is comprised of polymer chains having pendant blocked isocyanate groups bound thereto and Zerewitinoff active hydrogens bound thereto wherein said rubber is comprised of repeat units which are derived from one or more diene monomers, and (b) at least one fiber.

4. Gasketing paper which is comprised of (a) at least one dry rubber which is comprised of polymer chains having pendant blocked isocyanate groups bound thereto and Zerewitinoff active hydrogens bound thereto wherein said rubber is comprised of repeat units which are derived from one or more diene monomers, (b) at least one fiber and (c) at least one filler.

5. Gasketing paper as specified in claim 4, wherein said gasketing paper is comprised of (a) from about 5 to about 20 weight percent of the dry rubber, (b) from about 5 to about 35 weight percent cellulose fiber, and (c) at least about 50 weight percent of an inorganic filler.

6. A gasketing paper which is comprised of (a) at least one dry rubber which is comprised of polymer chains having pendant blocked isocyanate groups bound thereto and Zerewitinoff active hydrogens bound thereto wherein said rubber in comprised of repeat units which are derived from one or more diene monomers, and (b) at least one floor, wherein the dry rubber is comprised of repeat units which are derived from 40 to 60 weight percent 1,3-butadiene, 20 to 40 weight percent acrylonitrile, 3 to 8 weight percent tetrahydro-N-[1-methyl-1-[3-(1-methylethenyl)phenyl]ethyl]-2-oxo-1-H-pyrrolo-1-carboxamide, and 1 to 4 weight percent hydroxypropylmethacrylate.

7. A gasketing paper which is comprised of (a) at least one dry rubber which is comprised of polymer chains having pendant blocked isocyanate groups bound thereto and Zerewitinoff active hydrogens bound thereto wherein said rubber is comprised of repeat units which are derived from one or more diene monomers, and (b) at least one fiber, wherein the dry rubber is comprised of repeat units which are derived from 40 to 60 weight percent 1,3-butadiene, 20 to 40 weight percent acrylonitrile, 3 to 8 weight percent hexahydro-N-(1-methyl-1-(3-(1-methylethenyl)phenyl)ethyl-2-oxo-1H-azepine-1-carboxyamide and 1 to 4 weight percent hydroxypropylmethacrylate.

8. A gasketing paper which is comprised of (a) at least one dry rubber which is comprised of polymer chains having pendant blocked isocyanate groups bound thereto and Zerewitinoff active hydrogens bound thereto wherein said rubber is comprised of repeat units which are derived from one or more diene monomers, and (b) at least one fiber, wherein the dry rubber is comprised of repeat units which are derived from 50 to 55 weight percent 1,3-butadiene, 35 to 45 weight percent acrylonitrile, 4 to 6 weight percent tetrahydro-N-[1-methyl-1-[3-(1-methylethenyl)phenyl]ethyl]-2-oxo-1-H-pyrrolo-1-carboxamide and 2 to 3 weight percent hydroxypropylmethacrylate.

9. A gasketing paper which is comprised of (a) at least one dry rubber which is comprised of polymer chains having pendant blocked isocyanate groups bound thereto and Zerewitinoff active hydrogens bound thereto wherein said rubber is comprised of repeat units which are derived from one or more diene monomers, and (b) at least one fiber, wherein the dry rubber is comprised of repeat units which are derived from 50 to 55 weight percent 1,3-butadiene, 35 to 45 weight percent acrylonitrile, 4 to 6 weight percent hexahydro-N-(1-methyl-1-(3-(1-methylethenyl)phenyl)ethyl-2-oxo-1H-azepine-1-carboxyamide and 2 to 3 weight percent hydroxypropylmethacrylate.

10. Gasketing paper as specified in claim 4 wherein said fiber is an aramid fiber.

* * * * *